United States Patent [19]

Palisin, Jr.

[11] 3,972,798

[45] Aug. 3, 1976

[54] ELECTROPLATING RACK

[75] Inventor: Stephen P. Palisin, Jr., South Euclid, Ohio

[73] Assignee: The Empire Plating Company, Cleveland, Ohio

[22] Filed: Dec. 23, 1974

[21] Appl. No.: 536,926

Related U.S. Application Data

[63] Continuation-in-part of Ser. No. 479,617, June 17, 1974.

[52] U.S. Cl. ..... 204/297 W; 204/297 R

[51] Int. Cl.[2] ..... C25D 17/08

[58] Field of Search ..... 204/297 R, 297 W, 297 M, 204/DIG. 7

[56] References Cited

UNITED STATES PATENTS

| | | | |
|---|---|---|---|
| 148,409 | 4/1874 | Bush | 204/297 W |
| 258,214 | 5/1882 | Brinckmann | 204/297 W |
| 2,196,663 | 4/1940 | Isile | 204/297 W |
| 2,505,531 | 4/1950 | Ellwood | 204/297 M |
| 2,760,923 | 8/1956 | Boguski | 204/34 |
| 2,911,347 | 11/1959 | Gutzmen | 204/297 M |

OTHER PUBLICATIONS

Degreasing and Plating Ferromegnetic Piece Parts Utilizing Magnetic Fields to Space Parts by Wyatt, Western Electric Tech. Dig. No. 25 Jan. 1972.

*Primary Examiner*—F. C. Edmundson
*Attorney, Agent, or Firm*—David A. Burge Co.

[57] ABSTRACT

An electroplating rack has a framework including a pair of interconnected uprights which support two vertically spaced grids. The grids have removable partitions for selectively forming different size apertures to receive long parts to be electroplated. Electrode bars underlie the lower grid and define exposed, upwardly facing electrode surfaces for engaging the lower ends of parts positioned in the grids.

9 Claims, 4 Drawing Figures

ELECTROPLATING RACK

CROSS-REFERENCES TO RELATED APPLICATION

The present application is a continuation-in-part of application Ser. No. 479,617, filed June 17, 1974.

BACKGROUND OF THE INVENTION

1. Field of the Invention

The present invention relates to electroplating racks and more particularly to a novel and improved rack for supporting a plurality of relatively thin elongated articles in spaced relationship for electroplating.

2. Prior Art

In modern automatic plating systems, a plurality of rack assemblies are used to support articles to be plated. The racks are hung on a bus bar positioned above tanks containing cleaning, plating and washing solutions. A programmed drive system sequentially moves the racks along the bus bar to prescribed stations over the tanks, lowers the bus bar to submerge the articles in the tank-carried solutions, and raises the bus bar to drain the solutions from the articles and racks before the racks are advanced to the next station.

The articles to be plated are used as cathodes of an electrolytic cell. The anode is formed from the metal to be plated. The electrolyte is a metal salt solution which presents ions of the plating metal to the cathode for deposition. As metal ions are depleted from the electrolyte, they are replenished by the anode.

The racks must be capable not only of securely holding a plurality of articles in properly spaced relationship, but must also provide a low impedence current path and make good electrical contact with the supported articles. Only a minimum surface area of the articles can be shielded from the electrolyte. The racks must be capable of holding a maximum number of articles to accommodate high production volumes, and yet must be of sufficiently simple construction so that circulation of the electrolyte is not inhibited.

Ideally the racks incorporate a minimum number of parts so they can be economically manufactured. The racks should occupy a minimum of storage space. The racks should be capable of accommodating different sizes of articles in an efficiently spaced arrangement.

Still another consideration of the design of electroplating racks is they must permit the expedient racking and unracking of articles.

A number of proposals have been made in the prior art to provide electroplating racks designed to accommodate long, thin articles. Many of these proposals are designed to suspend the long articles horizontally. Horizontal suspension is undesirable for a number of reasons, including the fact that it necessitates the use of long tanks to hold the cleaning, plating and washing solutions. When these long tanks are placed side-by-side in an automated production system, the system occupies an unacceptably large amount of floor space.

Most known racks which support long articles vertically are not well adapted to accommodate articles of a wide variety of sizes. Typically the racks are designed to accommodate a prescribed number of long articles regardless of their size. While such racks may efficiently hold two dozen articles having a relatively large cross-section in closely spaced relationship, two dozen smaller cross-section articles supported at the same on-center spacing is a highly inefficient arrangement.

A number of prior plating racks which are arranged to vertically support long articles use hooks which engage the upper end regions of the articles. Hook-support systems leave lower portions of the long articles free to dangle and to move relative to their supporting rack. If such relative movement occurs when a rack full of articles is being lowered into a plating tank, some of the articles may not enter the tank and may jam the operation of the automated system which positions the racks. If such relative movement occurs while the articles are being moved while suspended in a plating tank, the articles can tangle with an adjacent rack and cause the automated system to jam.

SUMMARY OF THE INVENTION

The present invention overcomes the foregoing and other drawbacks of the prior art by providing an electroplating rack having a pair of spaced grids for holding a plurality of long thin articles in closely spaced relationship and preventing significant relative movement between such articles and their supporting rack.

A framework includes a pair of spaced uprights formed from electrically conductive metal. A pair of hooks are provided to hang the rack from the bus bar of an automatic plating apparatus. The uprights carry vertically spaced pairs of arms. The uprights are connected near their lower ends by transversely extending bars. The bars are formed from an electrically conductive metal. The framework is coated with an electrically insulative material except in the regions of the bars where exposed, upwardly facing electrode surfaces are defined.

The grids have removable partitions for selectively defining grid apertures of different sizes to accommodate the cross-sections of the articles to be plated. The articles are supported on end with their lower ends in electrically conductive engagement with the electrode surfaces on the bars. By providing grids with removable partitions defining spaced apertures of different sizes, long, thin parts of a wide variety of shapes and sizes can be efficiently accommodated on the racks.

In the preferred embodiment, the removable partitions are rod-like members which extend through holes in arms at opposite ends of the grids. By removing certain of the partitions, grid apertures of larger sizes are provided to accommodate articles having large cross-sections.

One advantage of this type of rack structure is the ease with which the racks can be restructured to accommodate long, thin parts of different sizes. All that need be done, is to remove or insert partitions at a required spacing to form apertures which will receive the articles to be plated.

Another advantage of this type of rack structure is the ease with which plated articles can be unracked. The rack can simply be inverted to discharge the articles into a receptacle.

As will be apparent from the foregoing discussion, it is a general object of the present invention to provide a novel and improved electroplating rack.

Other objects and a fuller understanding of the invention may be had by referring to the following description and claims taken in conjunction with the accompanying drawing.

DESCRIPTION OF THE PREFERRED EMBODIMENT

Figure 1:
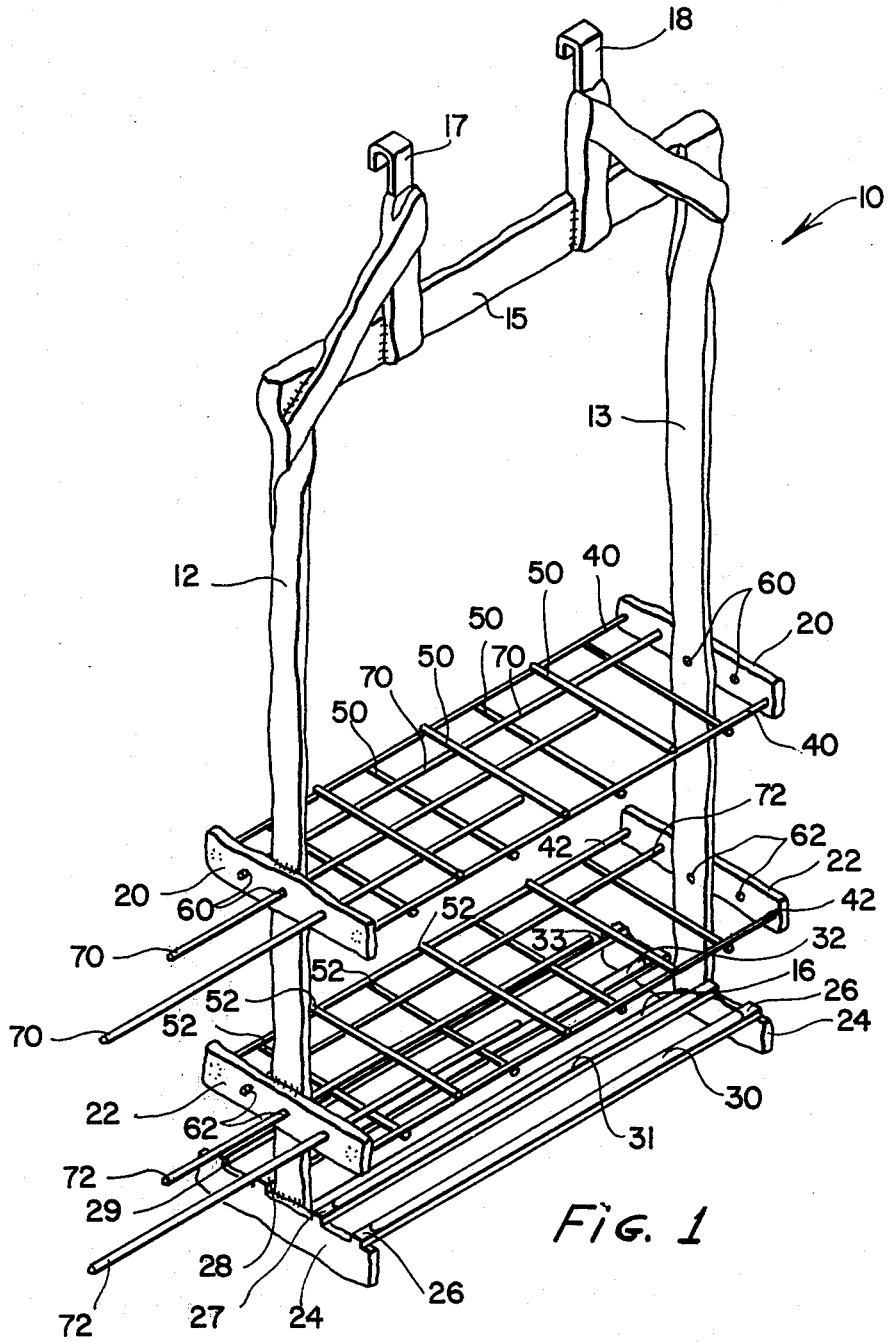
FIG. 1 is a perspective view of a rack constructed in accordance with the present invention.

Referring to FIG. 1, an electroplating rack is shown generally at 10. The rack 10 includes a pair of uprights 12, 13, top and bottom crossbars 15, 16, and a pair of hooks 17, 18 for supporting the framework from the bus bar of an automatic electroplating apparatus. Vertically spaced pairs of arms 20, 22, 24 are carried by the uprights 12, 13. Four bars 26, 27, 28, 29 extend between distal end regions of the lower pair of arms 24.

The uprights 12, 13, the crossbars 15, 16, the hooks 17, 18, the arms 20, 22, 24 and the bars 26, 27, 28, 29 define a rigid framework. An electrically insulative coating covers this framework except in the regions of the hooks 17, 18 and in regions extending across the tops of the bars 26, 27, 28, 29 which define exposed, upwardly facing electrode surfaces 30, 31, 32, 33.

The arms 20, 22 form the ends of a pair of grids. Two pairs of rods 40, 42 respectively rigidly interconnect the outer end regions of the arms 20, 22. A plurality of cross-members 50, 52 respectively rigidly interconnect the rods 40, 42 at spaced intervals between the arms 20, 22. The arms 20, 22, the rods 40, 42, and the cross-members 50, 52 define rigid grid structures with relatively large apertures to receive relatively large articles to be plated.

Spaced holes 60, 62 are formed in the arms 20, 22, and in the uprights 12, 13. Two sets of partition rods 70, 72 are provided for positioning in the holes 60, 62 to subdivide the grids to receive smaller articles. The grid components, including the arms 20, 22, the rods 40, 42, the cross-members 50, 52 and the removable partitions 70, 72 are all covered with an electrically insulative coating.

Alternate ones of the cross-members 50, 52 are secured to the top and bottom sides of the rods 40, 42. This alternate top and bottom arrangement of cross-members helps to support the removable partitions 70, 72 and prevents their vertical deflection.

Figure 2:
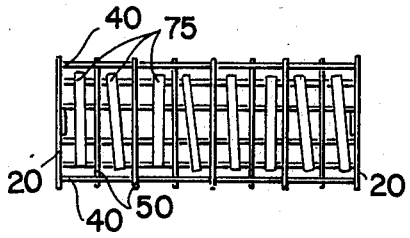
FIGS. 2, 3 and 4 are schematic top plan views illustrating alternative arrangements of articles in the rack of FIG. 1.
Figure 3:
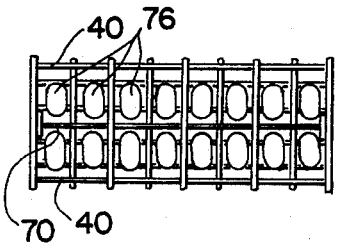
Figure 4:
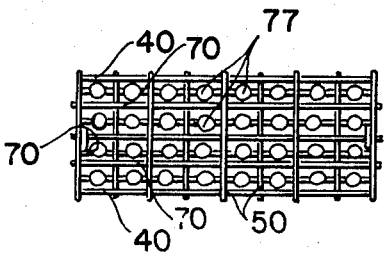

Referring to FIGS. 2, 3 and 4, alternative arrangements of articles 75, 76, 77 are illustrated. The arrangement of FIG. 2 utilizes none of the removable partitions 70, 72 and accommodates relatively large articles 75. The arrangement of FIG. 3 utilizes only one each of the partitions 70, 72 and accommodates intermediate sized articles 76. The arrangement of FIG. 4 utilizes three each of the partitions 70, 72 and accommodates relative small articles 77.

In operation, articles 75, 76, 77 to be plated are positioned on end in the rack 10 with their lower ends in electrically conductive engagement with the electrode surfaces 30, 31, 32, 33. After the articles have been plated, they can easily be unracked from the rack 10 by inverting the rack 10 to discharge the articles into a receptacle.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. An electroplating rack comprising:

a. an elecrically conductive framework including a pair of spaced uprights and bar means extending between and rigidly connecting said uprights near the lower ends thereof;

b. an electrically insulative material coating said framework except in the regions extending across the top of said bar means where exposed, upwardly facing electrode surface portions are defined;

c. a pair of grid structures carried by said framework at vertically spaced positions above said bar means, said grid structures defining a plurality of spaced apertures for receiving and supporting a plurality of long articles on end with their lower ends in electrically conductive engagement with said surface portions; and, d. said grid structures being adjustable to vary dimensions of at least some of the apertures defined by said grid structures.

2. The rack of claim 1 wherein said grid structures include removable partition means which, when removed, are operable to enlarge the size of at least some of the apertures defined by said grid structures.

3. An electroplating rack comprising:

a. an electrically conductive framework including a pair of spaced interconnected uprights having hooks for supporting the framework from a bus bar, and three pairs of vertically spaced arms carried on said uprights, each of said arms having a pair of ends extending in opposite directions from its associated uprights;

b. the lowermost pair of arms being electrically conductive and being interconnected by a plurality of electrically conductive bars;

c. the uppermost two pairs of arms being interconnected by spaced orthogonally arranged members defining a pair of grids overlying said conductive bars for receiving and supporting elongated articles to be plated with the lower ends of the articles in electrical contact with said conductive bars;

d. said uprights said arms, and said members being coated with an electrically insulative material; and, e. selected of said grid-defining members being movable to vary dimensions of grid openings formed by said grid-defining members.

4. The rack of claim 3 wherein certain of said grid-defining members are removable from said rack to enable said grids to receive and support elongated articles of larger cross-section.

5. The rack of claim 4 wherein said certain grid-defining members have opposite end regions removably carried in holes formed in said uppermost two pairs of arms.

6. The rack of claim 3 wherein:

a. said grid-defining members include at least three first members extending in parallel spaced relationship between said uppermost two pairs of arms, and cross-members arranged orthogonally to said first members in parallel spaced relationship and secured to at least two of said first members; and, b. predetermined ones of said first members which are not secured to said cross-members being removably carried by said uppermost two pairs of arms.

7. The rack of claim 6 wherein adjacent ones of said cross-members are arranged to alternately overlie and underlie said members.

8. An electroplating rack, comprising:

a. an electrically conductive upstanding framework including bar means extending substantially horizontally between at least a pair of uprights;

b. an electrically insulative material covering substantially all of the framework except regions on said bar means where exposed upwardly facing electrode portions are defined; and c. grid means including a pair of grid structures carried by the framework at vertically spaced positions above the electrode portions, the grid means being adjustable to define apertures of selected sizes to receive elongated articles for plating with lower end regions of the articles contacting the electrode portions.

9. The rack of claim 8 wherein said grid means include removable partition means which, when removed, are operable to enlarge the size of at least some of the apertures defined by said grid means.

* * * * *